US011122651B2

(12) United States Patent
Chen et al.

(10) Patent No.: US 11,122,651 B2
(45) Date of Patent: Sep. 14, 2021

(54) AIRFLOW HEATING ASSEMBLY HAVING A HEATING DEVICE AND A CONTAINER

(71) Applicant: Smiss Technology Co., Ltd., Shenzhen (CN)

(72) Inventors: Jiatai Chen, Shenzhen (CN); Shikai Chen, Shenzhen (CN)

(73) Assignee: SMISS TECHNOLOGY CO., LTD., Shenzhen (CN)

( * ) Notice: Subject to any disclaimer, the term of this patent is extended or adjusted under 35 U.S.C. 154(b) by 448 days.

(21) Appl. No.: 16/089,950

(22) PCT Filed: Apr. 28, 2017

(86) PCT No.: PCT/CN2017/082397
§ 371 (c)(1),
(2) Date: Sep. 28, 2018

(87) PCT Pub. No.: WO2017/144028
PCT Pub. Date: Aug. 31, 2017

(65) Prior Publication Data

US 2020/0305504 A1 Oct. 1, 2020

(30) Foreign Application Priority Data

May 27, 2016 (CN) ..... 201610369746.9

(51) Int. Cl.
*A24F 13/00* (2006.01)
*A24F 17/00* (2006.01)
(Continued)

(52) U.S. Cl.
CPC ..... *H05B 3/46* (2013.01); *A24F 40/42* (2020.01); *A24F 40/46* (2020.01); *A24F 40/48* (2020.01);
(Continued)

(58) Field of Classification Search
CPC ..... A24F 40/20; A24F 40/402; A24F 40/46; A24F 47/008; A24F 47/002
(Continued)

(56) References Cited

U.S. PATENT DOCUMENTS

2016/0120225 A1* 5/2016 Mishra ..... A24F 40/42 392/386
2017/0006918 A1* 1/2017 Chen ..... A24F 47/004
(Continued)

FOREIGN PATENT DOCUMENTS

CA 2937065 A1 11/2015
CN 101277623 A 10/2008
(Continued)

OTHER PUBLICATIONS

International Search Report for PCT/CN2017/082397 dated Jul. 18, 2017.

*Primary Examiner* — Hae Moon Hyeon
(74) *Attorney, Agent, or Firm* — Kilpatrick Townsend & Stockton LLP

(57) ABSTRACT

An airflow heating assembly, including a heating device (10) and a container (20), the heating device (10) being used for heating through-flowing air to produce a hot airflow, the container (20) being used for accommodating a raw material. The container (20) is arranged above the heating device (10), and a bottom portion of the container (20) is provided with air holes for maintaining airflow communication with the heating device (10). The heating device (10) includes an outer heating pipe (1) and an inner heating rod (2), the inner heating rod (2) is arranged in an inner cavity of the outer
(Continued)

heating pipe (1), and an airflow heating space is formed between an outer wall of the inner heating rod (2) and an inner wall of the outer heating pipe (1).

3 Claims, 2 Drawing Sheets

(51) Int. Cl.

| | |
|---|---|
| ***A24F 25/00*** | (2006.01) |
| ***H05B 3/46*** | (2006.01) |
| ***A24F 40/48*** | (2020.01) |
| ***A24F 40/46*** | (2020.01) |
| ***A24F 40/57*** | (2020.01) |
| ***A24F 40/42*** | (2020.01) |
| ***H05B 1/02*** | (2006.01) |
| ***H05B 3/48*** | (2006.01) |
| ***A24F 40/485*** | (2020.01) |
| ***A24F 40/50*** | (2020.01) |
| *A24F 40/20* | (2020.01) |

(52) U.S. Cl.
CPC ..... *A24F 40/485* (2020.01); *A24F 40/50* (2020.01); *A24F 40/57* (2020.01); *H05B 1/0297* (2013.01); *H05B 3/48* (2013.01); *A24F 40/20* (2020.01)

(58) Field of Classification Search
USPC ..... 131/328, 329
See application file for complete search history.

(56) References Cited

U.S. PATENT DOCUMENTS

| | | | | |
|---|---|---|---|---|
| 2017/0027227 | A1* | 2/2017 | Lipowicz | H05B 3/34 |
| 2017/0164653 | A1* | 6/2017 | Chen | A24F 47/004 |
| 2018/0014570 | A1* | 1/2018 | Nakano | A24F 42/10 |
| 2018/0325174 | A1* | 11/2018 | Sutton | A24F 40/20 |

FOREIGN PATENT DOCUMENTS

| | | | |
|---|---|---|---|
| CN | 103181622 | A | 7/2013 |
| CN | 103844360 | A | 6/2014 |
| CN | 103859605 | A | 6/2014 |
| CN | 204335821 | U | 5/2015 |
| CN | 204426671 | U | 7/2015 |
| CN | 204526156 | U | 8/2015 |
| CN | 104921306 | A | 9/2015 |
| CN | 204812023 | U | 12/2015 |
| CN | 105231489 | A | 1/2016 |
| CN | 204969475 | U | 1/2016 |
| CN | 204969477 | U | 1/2016 |
| CN | 105342015 | A | 2/2016 |
| CN | 105361245 | A | 3/2016 |
| CN | 105411004 | A | 3/2016 |
| CN | 205072071 | U | 3/2016 |
| WO | 2013137084 | A1 | 9/2013 |

* cited by examiner

AIRFLOW HEATING ASSEMBLY HAVING A HEATING DEVICE AND A CONTAINER

CROSS REFERENCE TO RELATED APPLICATIONS

The present application is a national phase entry under 35 U.S.C. § 371 of International Application No. PCT/CN2017/082397, filed Apr. 28, 2017, which claims priority from Chinese Patent Application No. 201610369746.9 filed May 27, 2016, all of which are hereby incorporated herein by reference.

TECHNICAL FIELD

The present disclosure relates to an airflow heating assembly.

BACKGROUND

In the field of using tobacco, herb, or other fragrance, a heating device is required to achieve the function of emitting smoke and fragrance. Generally, in a suction heating equipment such as a smoking device, the heating mode is continuous. Therefore, in the absence of a suction action, the heating device still is still heating and consuming the heated raw material. Similarly, when a cigarette is ignited, the cigarette is continuously burning and consuming the raw material, causing unnecessary waste of the raw material.

In the field of using tobacco, herb, or other fragrance, a heating device is required to achieve the function of emitting smoke and fragrance. Generally, a conventional heating device is a heating pipe that heats the airflow passing through its inside. The air near the wall of the heating pipe is heated at a higher speed, while the air in the middle area away from the wall is heated at a slower speed, thus the overall heating speed is slow, and the raw material is not heated uniformly. The applicant has applied two following patent applications about airflow preheating in 2015: Chinese Patent Application No.201510233789.X, entitled "Airflow Preheating Device" and Chinese Patent Application No.201510934148.7, entitled "New-style Airflow Heating Device". Both of the applications use the airflow preheating technology and combined with the direct conduction heating in the rear section, so as to cooperatively achieve a fumigate to the heating body (raw material). However, even though the heating speed is relatively higher, the heating speed is not high enough, the raw material is still wasted, and the device is not humanized enough.

SUMMARY

Accordingly, technical problem of the present disclosure is to provide an airflow heating assembly to address the problem that the heating speed is not high enough and the hot airflow passing through the raw material is not uniform in the conventional heating product for heating tobacco, fragrance, or the like.

The technical solution according to the present disclosure to solve the aforementioned technical problems is as follows:

An airflow heating assembly includes a heating device and a container. The heating device is used to heat air flowing therethrough to generate a hot airflow; the container is used to receive a raw material. The container is located above the heating device, the container defines a vent at a bottom thereof in communication with the heating device;

the heating device comprises an outer heating pipe and an inner heating rod located in an inner cavity of the outer heating pipe, and a heating space is formed between an outer wall of the inner heating rod and an inner wall of the outer heating pipe. The air entering from a bottom portion of the heating device is heated in the heating space via the outer heating pipe and the inner heating rod to generate the hot airflow, and the hot airflow rises into the container and heat the raw material in the container.

In addition, the container and the heating device is detachably connected.

In addition, a high temperature resistant spiral guiding groove is included. The high temperature resistant spiral guiding groove is sleeved on an outer circumference of the inner heating rod and received in the outer heating pipe, and the high temperature resistant spiral guiding groove is firmly in contact with the inner heating rod and the outer heating pipe.

In addition, the spiral guiding groove is a spring.

In addition, the outer heating pipe is a ceramic pipe, a thermistor wire and a heating wire are provided in a wall of the ceramic pipe, and the thermistor wire and the heating wire are integrally formed with the ceramic pipe.

In addition, the inner heating pipe is a ceramic rod, a thermistor wire and a heating wire are provided in the ceramic rod, and the thermistor wire and the heating wire are integrally formed with the ceramic rod.

In addition, the heating wire and the thermistor wire are coupled to a heating circuit located on a printed circuit board (PCB), the thermistor is configured to detect a temperature of the outer heating pipe or the inner heating rod and feed back to the heating circuit, the heating circuit is configured to increase or decrease an output power of the heating circuit to the heating wire according to a preset heating temperature.

In addition, the heating circuit is coupled to a battery.

In addition, the raw material is a tobacco, a fragrance, or an herb.

In addition, the airflow heating assembly further includes a supplementary device. The supplementary device is hollowed up and down, and is fixed on an inner wall of the container via a connection between upper and lower housing of the container, and the supplementary device is detachable via separating the upper housing and the lower housing of the container; the upper housing of the container is connected to the lower housing of the container via a knob.

In addition, the inner wall of the container is sector-shaped with a larger upper portion and a smaller lower portion.

In addition, the container further includes an airflow homogenizing device located on the bottom of the container and fixed above the bottom vent. The hot airflow rises through the vent and is uniformly dispersed via the airflow homogenizing device.

In the airflow heating assembly according to an embodiment of the present disclosure, the passing airflow is heated by the inner and outer heating member, such that the airflow is heated to reach a temperature required for atomizing the raw material quickly. The defect in prior art that since only one heating pipe is provided, the airflow in the middle of the heating pipe cannot be heated quickly as it is away from the heating wall is avoided. In the absence of any heat conducting to the container, only when there is a suction action to generate a negative pressure, the hot airflow is drawn to fumigate and heat the raw material in the container; when there is no negative pressure, the energy of the airflow immediately stops fumigating and heating the raw material, such that the raw material is saved.

Numeral Reference List:

| | | | |
|---|---|---|---|
| 10 | heating device | 20 | container |
| 1 | outer heating pipe | 2 | inner heating rod |
| 3 | stainless high temperature resistant spring | 4 | threaded socket |
| 5 | filter | 6 | upper housing of container |
| 7 | silicone pad | 8 | lower housing of container |
| 9 | container ring | | |

DETAILED DESCRIPTION OF THE EMBODIMENTS

Embodiments of the present disclosure are described more fully hereinafter with reference to the accompanying drawings, in which some embodiments of the present disclosure are shown. The various embodiments of the present disclosure may, however, be embodied in many different forms and should not be construed as limited to the embodiments set forth herein.

Figure 1:
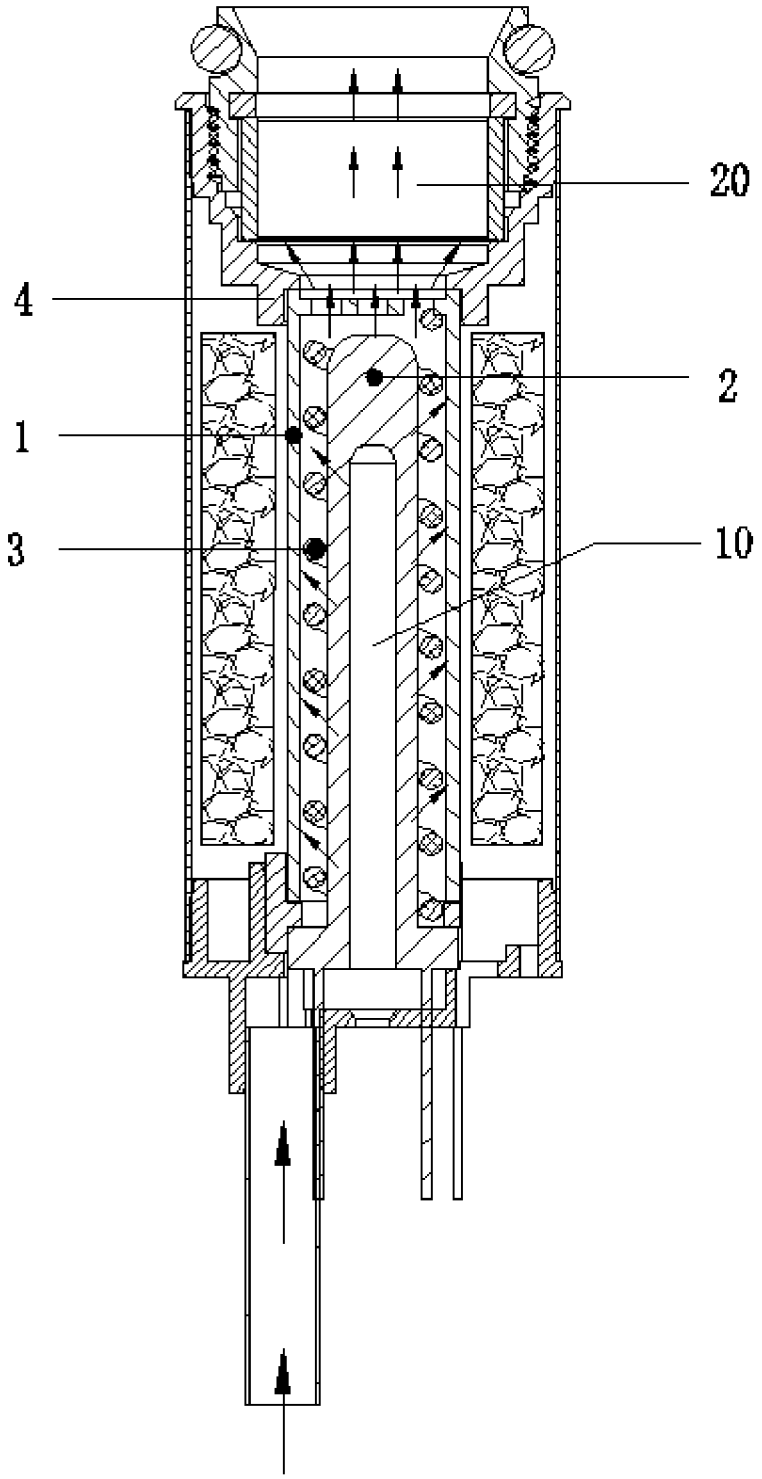
FIG. 1 is a cross-sectional view of an airflow heating assembly according to the present disclosure.

Referring to FIG. 1, an airflow heating assembly includes a heating device 10 used to heat air flowing through to generate a hot airflow; and a container 20 used to receive a raw material. Generally, the container 20 is made of a material with a good thermal insulating ability, such as glass, or an outer wall of the container 20 is provided with a thermal insulating structure or a thermal insulating material. The container 20 is located above the heating device. Preferably in the present disclosure, the container 20 is detachably connected to the heating device 10, so as to facilitate replacing parts and maintenance. As shown in FIG. 1, the container 20 is threadedly connected to the heating device 10 via a connection device, and the connection device is a threaded socket 4 shown in FIG. 1. The container 20 defines a vent at a bottom thereof in communication with the heating device 10.

Figure 2:
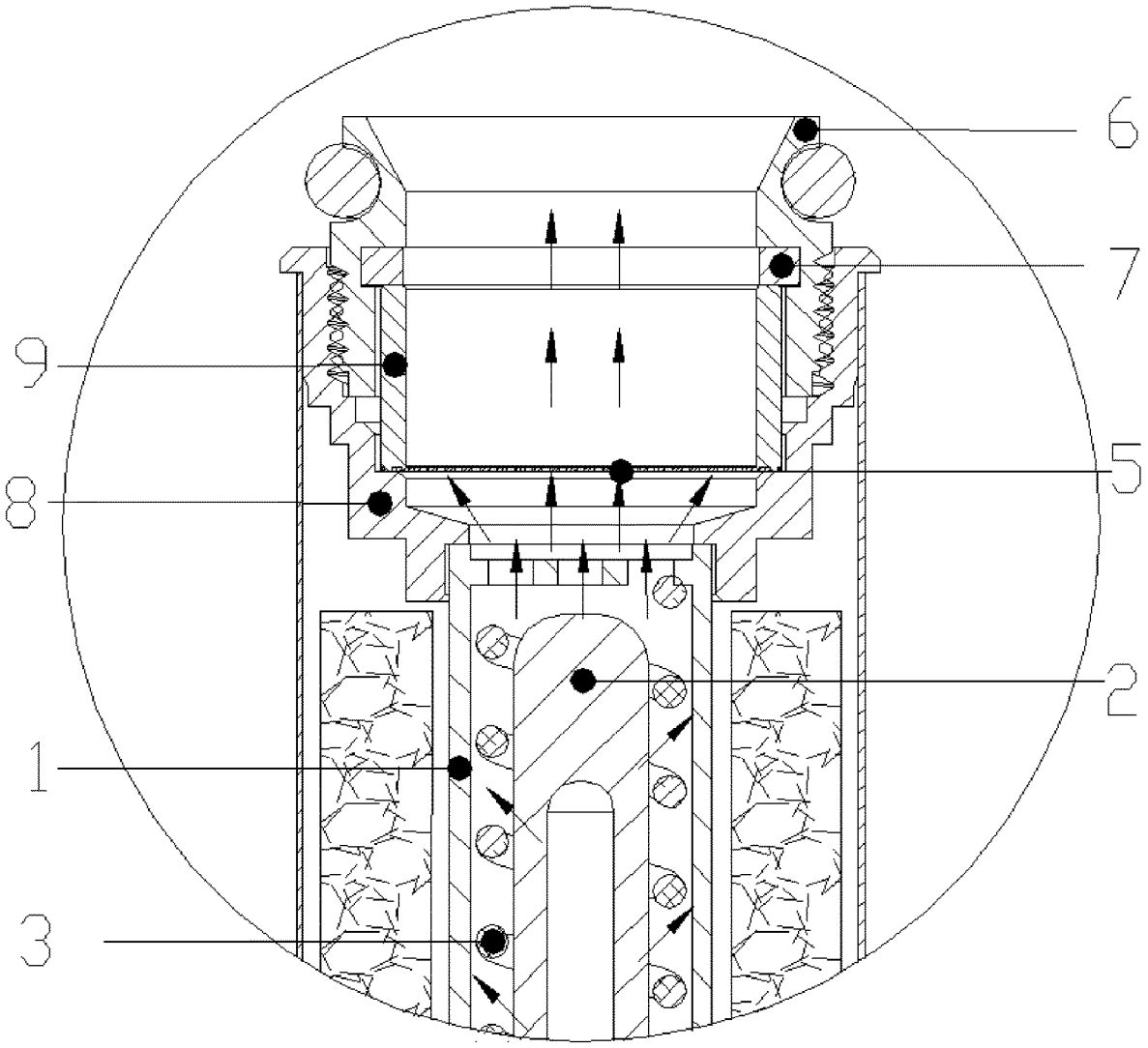
FIG. 2 is a cross-sectional view of a container of the airflow heating assembly according to the present disclosure.

Referring to FIG. 1, the hot airflow heated by the heating device 10 rises into an inner cavity of the container 20 via the vent on the bottom of the container 20. The container 20 is threadedly connected to the heating device 10 via by a connection device, and the connection device is the threaded socket 4 shown in FIG. 1. Due to the threaded socket 4, the container 20 is detachable. Referring to FIG. 2, the container 20 includes a upper housing 6 and a lower housing 8. The upper housing 6 of the container 20 is fixed to the lower housing 8 of the container 20 via a threaded knob. The raw material can be added into the container by detaching the upper housing 6 from the lower housing 8 of the container 20. Specifically, the upper housing 6 and the lower housing 8 of the container 20 are made of Polyether Ether Ketone (PEEK).

Referring to FIG. 2, the container 20 further includes a supplementary device that is hollowed up and down. The supplementary device is provided in the container 20 and is in close contact with the inner wall of the container 20. The supplementary device can be a container ring 9. A soft material is fixed to the upper housing 6 through an inner groove of the upper housing 6. The soft material is a material having a soft characteristic, specifically, it can be a silicone pad 7. The container ring 9 is fixed between the silicon pad 7 and the filter 5. When the container 9 is placed on the filter 5, and the upper housing 6 and the component consisting of the upper housing 6 and the silicon pad 7 is fixed to the lower housing 8 via the threaded knob, the container ring 9 is then fixed in a space between the silicon pad 7 and the filter 5. When the component consisting of the upper housing 6 and the silicon pad 7 is twisted out, the container ring can be detached, such that the container ring 9 is replaceable.

The shape of the container ring 9 depends on the shape of the inner wall of the container 20, the shape can be a circle, or any other shape such as a square, a diamond, or the like. The material of the container ring 9 can be customized according to requirements, so as to be diversified. The taste of the raw material in the container can be mixed to provide a rich taste/flavor experience. For example, a container ring made of wood can bring wood flavor, and the wood material can be pre-soaked with other herbs, so as to get a richer taste/flavor. As another example, a container ring made of glass and metal can get a pure taste/flavor from the raw material itself.

In addition to enriching the taste/flavor experience, since the container ring is in contact with the inner wall of the container, the inner wall of the container ring is in contact with the raw material, and the container ring can be detached anytime and anywhere, thus the container ring can be conveniently cleaned to avoid the influence of the long-term residuals, and the purer taste/flavor can be achieved. Additionally, the container ring also plays the role of thermal insulation.

On the basis that the detachable supplementary device can be detached and cleaned conveniently, the heating device 10 is further detachably connected to the container 20, which further facilitates the convenience of the cleaning of the container, so as to avoid the influence of the long-term residuals and achieve the purer taste/flavor.

Due to the presence of the supplementary device, and the rich taste/flavor experience from the supplementary device, the supplementary device can be frequently replaced by the user. If the supplementary device is frequently replaced, a higher requirement for uniform and rapid heating is imposed. Otherwise, since the container 20 is detachable, the parts are convenient to be replaced, repaired, and cleaned. After the replacement, repair, and cleaning, a higher requirement for uniform and rapid heating and the uniformness of the hot airflow to fumigate the raw material is also imposed. The cold air is rapidly and uniformly heated by following several ways or a combination thereof, such that the hot airflow can fumigate the raw material more uniformly and dispersedly.

Specifically, referring to FIG. 1, the heating device 10 includes an outer heating pipe 1 and an inner heating rod 2, the inner heating rod 2 is located in an inner cavity of the outer heating pipe 1, and a heating space is formed between an outer wall of the inner heating rod 2 and an inner wall of the outer heating pipe. The cold air enters from bottom of the heating device due to the negative pressure and enters the heating space. When the outer heating pipe 1 and the inner heating rod 2 simultaneously heat, the cold air is rapidly heated to form a hot airflow. The hot airflow rises into the inner cavity of the container 20 through the vent on the bottom of the container 20. The raw material, such as tobacco, fragrance, or herb, is received in the inner cavity of the container 20, and the filter is provided on the bottom of the container 20. The raw material is atomized by the hot airflow to generate a vaporization to form a smoke, then the hot airflow is cooled down and mixed with the smoke, and the mixture is discharged.

In order to ensure that the cold airflow entering the heating device 20 is sufficiently heated, a high temperature resistant spiral guiding groove is provided in the heating space. The high temperature resistant spiral guiding groove is sleeved on an outer circumference of the inner heating rod and received in the outer heating pipe. An inner side of the high temperature resistant spiral guiding groove is in firmly contact with the outer wall of the inner heating rod, and an outer side of the high temperature resistant spiral guiding groove is in firmly contact with the inner wall of the outer heating pipe. Due to the firm contacts between the three, the outer wall of the inner heating rod and the inner wall of the outer heating pipe serve as the left and right wall, so as to form a radially closed and spirally upward air passage. the air is guided by the high temperature resistant spiral guiding groove to spirally rise along the guiding groove, such that the flowing path of the air in the heating device is increased, the contacting area with the heating source is increased, and the air can receive more heat in the same time. Also, since the outer wall of the inner heating rod and the inner wall of the outer heating pipe cooperatively form the left and right walls of the air passage, the air is heated simultaneously by the inner heating rod and the outer heating pipe, thus the air flowing through is heated rapidly in a short time, and is uniformly heated both longitudinally and radically. Even if the container 20 is replaced occasionally, or the supplementary device (for example, the container ring 9) is frequently replaced by the user according to the requirement for changing taste/flavor, the cold air can still be heated rapidly and uniformly, so as to reach the temperature required for atomizing the raw material.

In the illustrated embodiment, referring to FIG. 1, the high temperature resistant spiral guiding groove is a stainless high temperature resistant spring 3, which has a small volume, a low heat absorption, a high coil count, and a rapid temperature rise. When the cold air enters the heating space, it rises spirally and is rapidly heated, and the cold air is uniformly heated both longitudinally and radically.

The outer heating pipe and the inner heating rod are ceramic rods, and a thermistor wire and a heating wire are provided in the ceramic rod, and the thermistor wire and the heating wire are integrally formed with the ceramic rod. Compared with the prior art that a thermal probe is attached to the outside of the wall of the ceramic pipe, forming the thermistor wire and the heating wire integrally with the ceramic pipe can widen the detect range of the thermistor wire, make the heating from the heating wire to the ceramic pipe more uniform, and the temperature detection more reliable. Moreover, forming the thermistor wire and the heating wire integrally with the ceramic pipe makes the production and assembly process simpler, the product more space-saving and inodorous.

The heating wire and the thermistor wire are coupled to a heating circuit, the heating circuit is coupled to a battery, and the heating circuit is located on a PCB board. The thermistor wire is used to detect a temperature of the outer heating pipe or the inner heating rod and feed back to the heating circuit, the heating circuit is used to increase or decrease an output power thereof to the heating wire according to a preset heating temperature. In other words, when the temperature exceeds an upper limit of the preset temperature, the heating circuit decreases the output power, such that the temperature of the outer heating pipe or the inner heating rod returns to the set range; when the temperature is lower than a lower limit of the set temperature, the heating circuit increases the heating power, such that the temperature of the outer heating pipe or the inner heating rod returns to the set range. Through this intelligent control, the heating temperature of the heating device to the airflow is configured within the preset optimal temperature range, such that the raw material in the container is most properly atomized or vaporized. The inner heating rod, the outer heating pipe, and the high temperature resistant spiral guiding groove cooperatively serve to heat the cold air rapidly and uniformly, also, the temperature detection and control are more precise according to the method described above. These functions cooperate with each other and strengthen each other, thereby allowing the cold air to be heated into a hot airflow rapidly and uniformly.

In order to ensure the air-tightness of the airflow passage of the airflow heating assembly, sealing rings are provided on the connection areas between each of the parts. The sealing rings are made of a heat-resistant material. Plastic parts are provided on the airflow heating assembly, which are also preferably made of the heat-resistant material, such as PEEK.

Due to the function of the heating device, the cold air is rapidly and uniformly heated into the hot airflow. In order to further make the hot airflow fumigate the raw material uniformly and dispersedly, the inner wall of the container 20 is sector-shaped with a larger upper portion and a smaller lower portion. Also, an airflow homogenizing device is provided in a built-in groove on the lower housing 8 of the container 20, the airflow homogenizing device can be a filter 5 having fine pores. The sector-shaped design of the inner wall of the container and the homogenization from the airflow homogenizing device on the bottom cooperatively make the hot airflow fumigate the raw material more uniformly and dispersedly. In addition to being sector-shaped, the inner wall of the container 20 can also have other shape that has a larger upper portion and a smaller lower portion, such as an arc.

The hot airflow that finally fumigate the raw material is subject to two homogenizing processes. Firstly, the cold air is heated into the hot airflow rapidly and uniformly through the aforementioned heating device. Secondly, the hot airflow becomes further dispersed and uniform in the container due to the cooperative functions of the airflow homogenizing device and the sector-shaped inner wall of the container. These two homogenizations of the hot airflow allow the final fumigation to the raw material being more homogenized. The airflow heating assembly according to the illustrated embodiment heats the airflow passing through via the cooperative functions of the inner heating rod and the outer heating pipe with a fast heating speed. Due to the negative pressure caused by a negative pressure action, the hot airflow rises and passes through the heated raw material, and realize a thermal conduction to the heated raw material. When the negative pressure action stops, no airflow rises, i.e., there is no hot airflow to heat the raw material, and the problem of the waste of the raw material caused by a continuous heating is avoided.

Typically, the airflow heating assembly according to the present disclosure can be used in a product such as an electronic cigarette, a perfume fumigation device and the like.

It should be noted that, the technical features in the aforementioned embodiments of the method are applicable to the device, and details are not described herein again.

Although the preferred embodiment is illustrated and described herein with reference to the accompanying drawings, the invention is not intended to be limited to the details shown. Rather, various modifications may be made in the details within the scope and range of equivalents of the claims and without departing from the present disclosure.

What is claimed is:

1. An airflow heating assembly, comprising a heating device and a container, wherein the heating device is configured to heat air flowing there through to generate a hot airflow; the container is configured to receive a raw material; wherein the container is located above the heating device, the container defines a vent at a bottom thereof in communication with the heating device, and an inner wall of the container is sector-shaped with a larger upper portion and a smaller lower portion; the heating device comprises an outer heating pipe and an inner heating rod located in an inner cavity of the outer heating pipe, and a heating space is formed between an outer wall of the inner heating rod and an inner wall of the outer heating pipe; the air entering from a bottom portion of the heating device is heated in the heating space via the outer heating pipe and the inner heating rod to generate the hot airflow, and the hot airflow rises into the container and heat the raw material in the container.

2. The airflow heating assembly according to claim 1, wherein the container is detachably connected to the heating device.

3. The airflow heating assembly according to claim 1, wherein the raw material is a tobacco, a fragrance, or an herb.

* * * * *